US005771992A

United States Patent [19]

Snyder

[11] Patent Number: 5,771,992

[45] Date of Patent: Jun. 30, 1998

[54] SAFETY SUPPORT STRUCTURE FOR LEVELING A LADDER

[76] Inventor: Harry A. Snyder, 800 E. Benton, Carrollton, Mo. 64633

[21] Appl. No.: 716,866

[22] Filed: Sep. 20, 1996

[51] Int. Cl.[6] ..... E06C 1/00

[52] U.S. Cl. ..... 182/200; 182/45

[58] Field of Search ..... 182/45, 120, 121, 182/122, 200; 248/235, 236, 237

[56] References Cited

U.S. PATENT DOCUMENTS

| | | | |
|---|---|---|---|
| 1,028,362 | 6/1912 | King | 182/45 |
| 2,549,638 | 4/1951 | Rogghe | 248/237 |
| 2,969,126 | 1/1961 | Gardner | 182/202 |
| 3,102,606 | 9/1963 | Hopfeld | 182/202 |
| 3,526,296 | 9/1970 | Stevens | 182/45 |
| 4,095,671 | 6/1978 | Forristall et al. | 182/202 |
| 4,244,446 | 1/1981 | Mair | 182/172 |
| 4,342,374 | 8/1982 | Montana | 182/200 X |
| 4,917,345 | 4/1990 | Czech | 248/237 X |
| 5,050,705 | 9/1991 | Natwick | 182/45 |
| 5,318,148 | 6/1994 | Franco et al. | 182/45 |
| 5,339,921 | 8/1994 | Faupel | 182/200 X |
| 5,341,898 | 8/1994 | Baziuk | 182/45 X |
| 5,474,271 | 12/1995 | Raymond | 248/237 |
| 5,570,864 | 11/1996 | Flores | 248/237 X |
| 5,624,006 | 4/1997 | Richardson, Jr. | 182/45 |

FOREIGN PATENT DOCUMENTS

| | | | |
|---|---|---|---|
| 3709441 | 10/1988 | Germany | 182/45 |
| 977624 | 12/1964 | United Kingdom | 182/200 |

*Primary Examiner*—Alvin C. Chin-Shue
*Assistant Examiner*—Richard M. Smith
*Attorney, Agent, or Firm*—Joseph N. Breaux

[57] ABSTRACT

A safety support structure for leveling a ladder placed thereupon and providing a support surface over an otherwise unsafe terrain, such as soft soil or sloping or uneven terrain, thereby eliminating danger to the user. The safety support structure comprises a frame structure having a base frame, a plurality of lateral stabilizing bars and a plurality of vertical support structures. The safety support structure further comprises a leveler and support surface structure coupled to the vertical support structures for leveling a ladder placed thereon and for providing a support surface over the otherwise unsafe surface and attachable anchoring components for anchoring the frame structure to the otherwise unsafe surface.

3 Claims, 2 Drawing Sheets

10
20
23
48
II
47
32
46'
45'
49'
39b'
37
40
38b'
42
50'
51
52
34'
38a'
36a'
48'
45
49
24
44
46
39a'
30
22
50
34
39a
39b 22a
24
20
22b
21
22

SAFETY SUPPORT STRUCTURE FOR LEVELING A LADDER

TECHNICAL FIELD

The present invention relates to support structures for a ladder and, more particularly, to a safety support structure for leveling a ladder, such as an extension ladder or the like, when positioned thereupon and for providing a secure support surface over an otherwise unsafe surface, such as soft soil or sloping or uneven terrain but not limited thereto, thereby preventing danger to the user.

BACKGROUND OF THE INVENTION

Extension ladders or the like are placed upon a surface, such as the earth's terrain, allowing a user to climb to otherwise inaccessible high places. The soil at a construction site or after rain is soft; hence, a ladder when placed thereupon is susceptible to slipping or sinking, as the user climbs up thereon, which is dangerous. Furthermore, because the earth's terrain may be uneven or sloping, placing a ladder securely upon the earth's terrain is often cumbersome, if not impossible. Henceforth, support structures for stabilizing ladders on otherwise unsafe surfaces have been developed.

Several support structures have been patented which are aimed at supporting ladders or the like.

U.S. Pat. No. 4,244,446 is directed to a ladder support structure comprising angled supports attached to the ladder for providing lateral stability. Although, the invention is directed to a support structure for a ladder, the ladder support structure requires attachment to the ladder and does not secure the ladder in soft soil nor provides a support surface over uneven or sloping terrain.

U.S. Pat. Nos. 2,969,126, 3,102,606 and 4,095,671 are directed to a support structure having adjustable legs attached to the ladder for placing the ladder on uneven or sloping supporting surfaces. The inventions do not provide a support surface over the unsafe surface, such as soft soil or uneven or sloping terrain.

The known support structures for a ladder do not address the need for a safety support structure for leveling a ladder positioned thereupon and for providing a support surface over an otherwise unsafe surface, such as soft soil or sloping or uneven terrain, thereby eliminating danger to the user.

SUMMARY OF THE INVENTION

The preferred embodiment of the apparatus of the present invention solves the aforementioned problems in a straight forward and simple manner. What is provided is a safety support structure for leveling a ladder placed thereupon and for providing a support surface over an otherwise unsafe terrain, such as soft soil or sloping or uneven terrain, thereby eliminating danger to the user.

In particular, the safety support structure comprises a frame structure having a base frame, a plurality of lateral stabilizing means and vertical support structures; leveler and support surface means coupled to said vertical support structures for leveling a ladder placed thereon and for providing a support surface over the otherwise unsafe surface; and a plurality of attachable anchoring means.

In view of the above, an object of the invention is to provide a safety support structure having a leveler and support surface means that is easily adjusted incrementally for leveling a ladder over varying unevenness or sloping contours of the otherwise unsafe surface.

A further object of the invention is to provide a safety support structure having a leveler and support surface means that securely supports a ladder or the like over soft soil.

It is a still further object of the invention to provide a safety support structure having a plurality of attachable anchoring means for securely anchoring the frame structure to the otherwise unsafe surface, such as the earth's terrain, thereby preventing movement of the frame structure thereon.

It is a still further object of the invention to provide a safety support structure that is inexpensive and easy to assemble.

It is a still further object of the invention to provide a safety support structure having a plurality of lateral stabilizing means coupled to the base frame which are removable and adjustable for stabilizing the frame structure upon the otherwise unsafe surface.

It is a still further object of the invention to provide a pad over a support plate of the leveler and support surface means whereby the pad prevents the ladder placed thereon from sliding or skidding, as a user climbs up the ladder.

Another object of the invention is to provide a safety support structure that is a safe and effective means of stability for an extension ladder or the like for use on all types of surfaces.

A feature of the invention is that the safety support structure is usable outdoors, as well as, indoors.

A further feature of the invention is to provided a safety support structure that is lightweight and compact so that the safety support structure is easily transportable.

The above objects and other features of the present invention will become apparent from the drawing, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and, wherein.

DETAILED DESCRIPTION OF THE EXEMPLARY EMBODIMENT

Figures 1, 2:
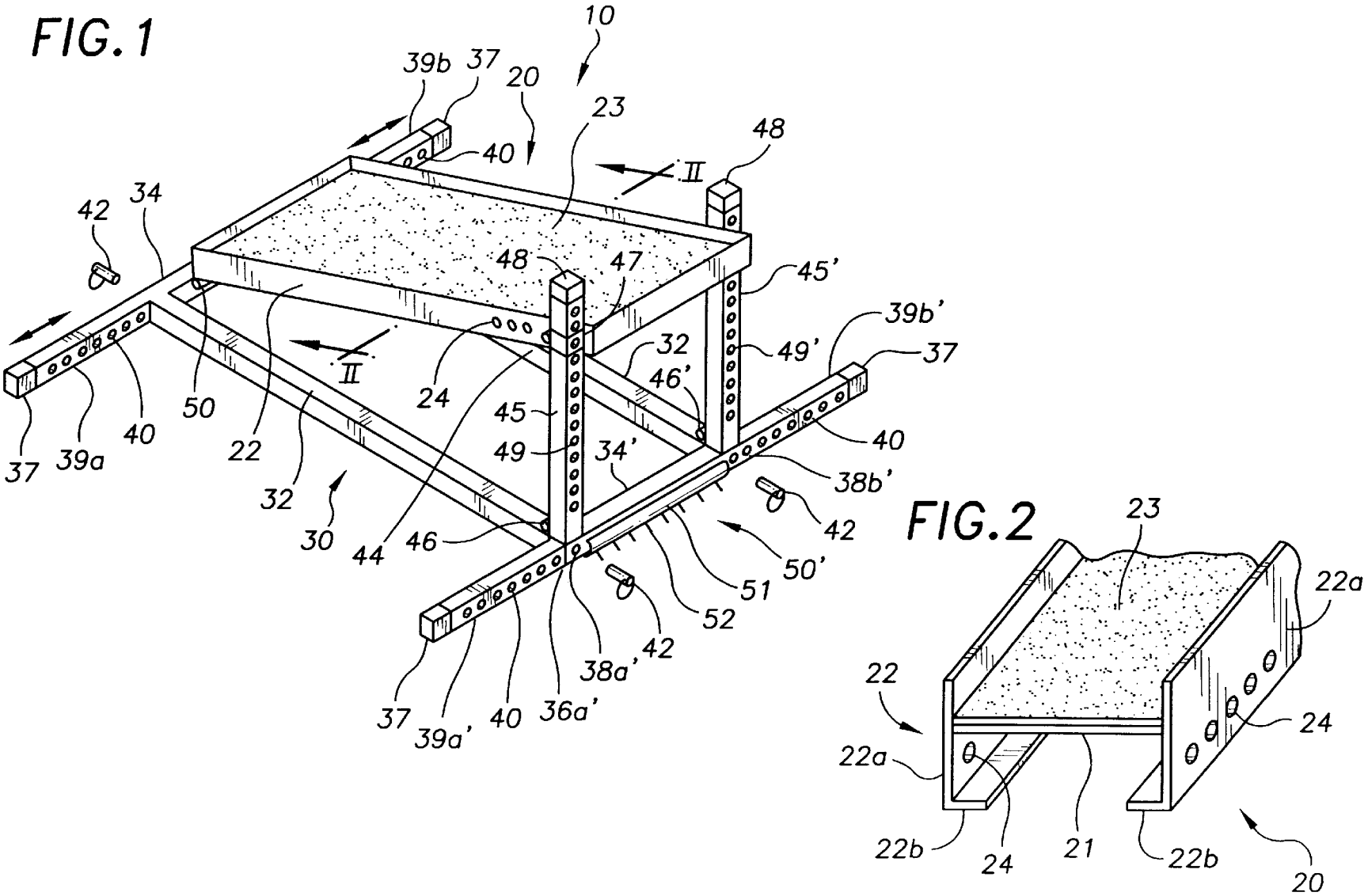
FIG. 1 illustrates a perspective view of an exemplary embodiment of the safety support structure of the present invention.
FIG. 2 Illustrates a cross-sectional view of the leveler and support structure taken in the plane 2—2 of the embodiment of FIG. 1.

Referring now to the drawings, and in particular FIG. 1, the safety support structure of the present invention is designated generally by the numeral 10. Support structure 10 of FIG. 1 is comprised of leveler and support surface means 20, frame structure 30, and plurality of attachable anchoring means 50 and 50'.

Leveler and support surface means 20 comprises a support plate 21 (FIG. 2), support plate frame 22 and pad 23. Support plate 21 is substantially shaped in the form of a parallelogram. As depicted in FIG. 2, a cross-sectional view of leveler and support means 20, the top surface area of support plate 21 has disposed thereon pad 23 thereby preventing the ladder or the like from sliding or skidding, as the user climbs up the ladder. In the exemplary embodiment, support plate 21 is made of steel; however, any suitable material having sufficient strength to firmly support a ladder or the like, user and accompanying tools may be substituted. Pad 23 is a 3-M non-skid pad or the like.

Support plate frame 22 surrounds the perimeter of support plate 21 wherein support plate 21 is perpendicularly coupled in the center thereof. As is shown in FIG. 2, support plate frame 22 is formed substantially in the shape of an "L" thereby forming ledge 22*b* extending inward from and perpendicular to the lowermost edge of vertical surface 22*a* of support plate frame 22. Vertical surface 22*a* above perpendicular support plate 21 functions as a stop wall for an edge of the legs of the ladder as said edge abuts thereagainst; henceforth, the ladder is prevented from moving off support plate 21. At one distal end of leveler and support surface means 20, ledge 22*b* of support plate frame 22 couples to two pivot hinges 31 and 31' (FIG. 4) placed along the top surface area of short frame bar 34 thereby allowing the other distal end of leveler and support surface means 20 to be incrementally raised in accordance with the slope or unevenness of the underneath surface so as to form a substantially level support surface for placing a ladder thereon. If the underneath surface is observably flat but comprises soft soil, leveler and support surface means 20 is not raised and said other distal end rests upon short frame bar 34' whereby a support surface over an otherwise unsafe surface is provided. Nonetheless, safety support structure 10 may also be used on an otherwise level safe surface for providing a safe and effective means of stability for the ladder. At said other distal end of leveler and support surface means 20 and below support plate 21, left and right sides of support plate frame 22 comprise a plurality of equally spaced leveler apertures 24 for sliding leveler support rod 25 (FIG. 3) therethrough.

Preferably, when safety support structure 10 is used outdoors on the earth's terrain, a plurality of attachable anchoring means 50 and 50' are slidably attached to short frame bars 34 and 34', respectively, thereby firmly anchoring frame structure 20 to the underneath surface. Since each of the plurality of attachable anchoring means 50 and 50' are identical, it will be necessary to describe only one such anchoring means in detail. Anchoring means 50 comprises channel rail 51 and a plurality of spike means 52 spaced along the exterior bottom surface area of channel rail 51. Channel rail 51 matingly fits the contour of short bar 34 and is slidably attached thereto. Depending on the surface indoors on which safety support structure 10 is placed, the plurality of anchoring means 50 and 50' should be removed to prevent damage to the plurality of spike means 52. Alternatively, safety support structure 10 may be equipped with a plurality of anchoring means which couple to the long frame bars 32 and 32' and/or stabilizing means 39*a*, 39*b*, 39*a'* and 39*b'*. In the exemplary embodiment, the plurality of anchoring means are made of plastic material or the like.

Figure 4:
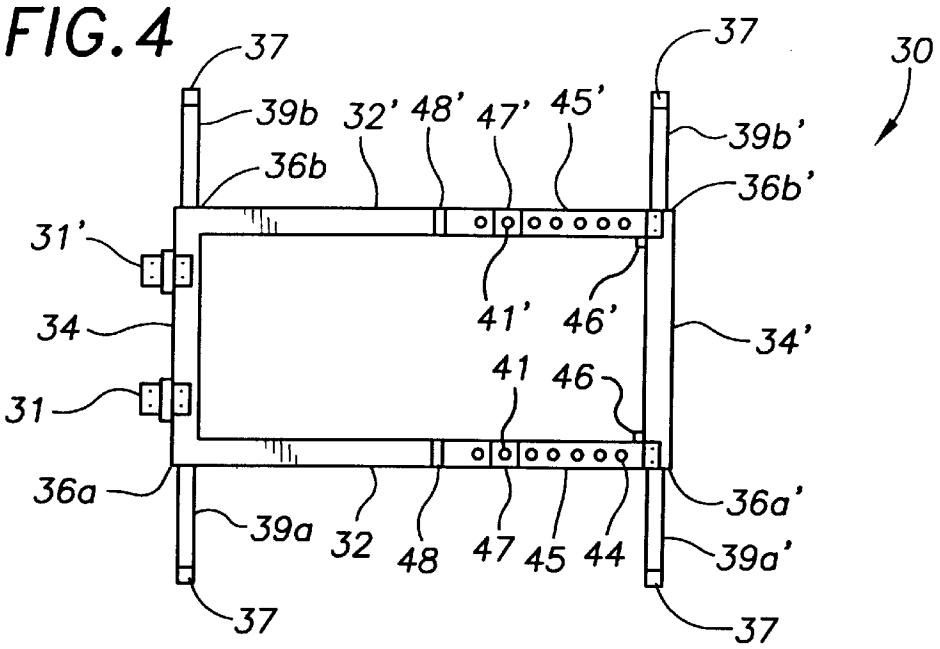
FIG. 4 illustrates a top plan view of the frame structure of the embodiment of FIG. 1.

Referring now to FIG. 4, a top plan view of frame structure 30, frame structure 30 comprises two parallel long frame bars 32 and 32' and two parallel short frame bars 34 and 34' forming a substantially rectangularly shaped unitary base frame. Preferably, long frame bars 32 and 32' and short frame bar 34 and 34' are substantially square hollow tubular members and although the exemplary embodiment illustrates a unitary base frame, detachable long frame bars 32 and 32' and short frame bars 34 and 34' for connection theretogether may be substituted.

Frame structure 30 further comprises four openings 36*a*, 36*b*, 36*a'* and 36*b'* each formed in each distal end of short frame bars 34 and 34', respectively, four bar apertures (only 38*a'* and 38*b'* shown in FIG. 1) each formed in the exterior surface area of each short frame bar 34 and 34' adjacent each distal end of short frame bars 34 and 34', respectively, and a plurality of attachable lateral stabilizing means 39*a*, 39*b*, 39*a'* and 39*b'*. Since each of the plurality of attachable lateral stabilizing means 39*a*, 39*b*, 39*a'* and 39*b'* are identical only one will be described in detail.

As is shown in FIG. 1, attachable lateral stabilizing means 39*a'* has formed therein a plurality of equally spaced front stabilizer apertures 40 and a plurality of equally spaced back stabilizer apertures (not shown) which are aligned theretogether. Attachable lateral stabilizing means 39*a'* comprises stabilizer locking pin 42. One distal end of lateral stabilizer means 39*a'* matingly slides into its respective opening 36*a'* and is secured therein via stabilizer locking pin 42 slid through bar aperture 38*a'*, one of said plurality of back stabilizer apertures and one of the plurality of front apertures 40 which are aligned theretogether. The length of protrusion of lateral stabilizing means 39*a'* from said base frame may be adjusted by sliding said one distal end of lateral stabilizing means 39*a'* farther into short bar 34' via opening 36*a'*. Lateral stabilizer means 39*a'* is a square hollow tubular member and its other distal end, preferably, has coupled therein cap 37 having a mating fit with the hollow opening.

Short frame bar 34 comprises two pivot hinges 31 and 31' (FIG. 4) placed on the top surface area thereof. Pivot hinges 31 and 31' (FIG. 4) couple in a conventional manner to ledge 22*b* (FIG. 2) of "L" shaped support plate frame 22 thereby permitting leveler and support surface means 20 to be incrementally raised in accordance with the sloping or unevenness of the underneath surface.

Referring to FIGS. 1 and 4, frame structure 30 further comprises a plurality of vertical support structures 45 and 45' coupled to the top surface area defined by the two corners of long frame bars 32 and 32' and short frame bar 34' of said base frame via pivot hinges 46 and 46'. Pivot hinges 46 and 46' are coupled in a conventional manner to the top surface area of said base frame and a bottom surface area covering one distal end of vertical support structures 45 and 45', respectively, for pivoting vertical support structures 45 and 45' longitudinally upward into position when safety support structure 10 is assembled for use. When safety support structure 10 is unassembled, vertical support structures 45 and 45' horizontally rest upon long frame bars 32 and 32', respectively, as shown in FIG. 4. Furthermore, when safety support structure 10 is unassembled lateral stabilizing means 39*a*, 39*b*, 39*a'* and 39*b'* are detached thereby providing a compact transportable safety support structure 10. Since the plurality of vertical support structures 45 and 45' are identical only one such vertical support structure 45 will be described in detail.

Figure 3:
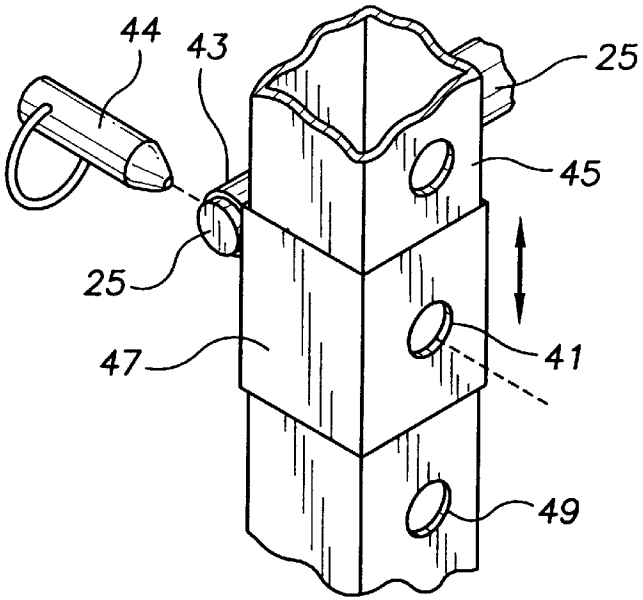
FIG. 3 illustrates an exploded sectional view of the vertical support structure of the embodiment of FIG. 1.

Referring now to FIG. 3, an exploded sectional view of vertical support structure 45 is illustrated. Vertical support structure 45 is a substantially square shaped hollow tubular member and its other distal end, preferably, has coupled therein cap 48 having a mating fit with the hollow square opening. Vertical support structure 45 has formed therein a plurality of equally spaced front vertical apertures 49 along its front side and a plurality of equally spaced back vertical apertures (not shown) along its back side which, are aligned theretogether. Vertical support structure 45 comprises sleeve 47, a substantially square shaped hollow member, matingly fitted around vertical support structure 45 such that sleeve 47 is incrementally slid longitudinally along vertical support structure 45 in accordance with the sloping or unevenness of the underneath surface and sleeve locking pin 44.

Sleeve 47 has formed therein front sleeve aperture 41 and a back sleeve aperture (not shown) which are aligned theretogether. Sleeve 47 comprises sleeve bracket support 43 fixedly coupled thereto for supporting leveler support rod 25 slid therethrough. As front sleeve aperture 41 aligns with a respective one of the plurality of front vertical apertures 49, the length of sleeve 47 is substantially the length between halfway below the front vertical aperture immediately above and halfway above the front vertical aperture immediately below said respective one of the plurality of front vertical apertures 49. Sleeve bracket support 43 has formed therein a bracket aperture (not shown) which is aligned with said back sleeve aperture (not shown). Leveler support rod 25 is a solid cylindrically shaped member having formed therein two rod apertures (not shown) each of which align with said bracket aperture (not shown) and said back sleeve aperture (not shown) of each sleeve 47 and 47' (FIG. 4).

Preferably, the components of frame structure 20 and support frame 22 are made of aluminum, steel or the like.

Figure 5:
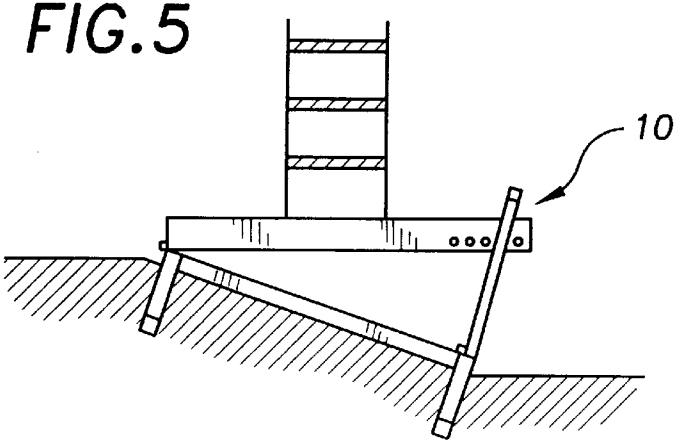
FIG. 5 illustrates the safety support structure, having an extension ladder thereon, of the present invention deployed.

The following description will be referring to the use and operation of safety support structure 10 of the present invention deployed, as shown in FIG. 5. The user of safety support structure 10 should attach each of the plurality of stabilizing means 39*a*, 39*b*, 39*a'* and 39*b'* and adjust their length of protrusion in accordance with the contours of the surface, such as the earth's terrain, and other obstructions, such as plants and bushes of the landscape. Each stabilizing means 39*a*, 39*b*, 39*a'* and 39*b'* are adjusted individually by sliding each of said stabilizing means into openings 36*a*, 36*b*, 36*a'* and 36*b'*, respectively. Each of said stabilizing means is then secured in place via its respective stabilizer locking pin 42.

Vertical support structures 45 and 45' are then longitudinally pivoted in position, if a slope or unevenness of the surface is observed. Leveler and support surface means 20 is incrementally raised in accordance to the observed sloping or unevenness of the surface. Sleeves 47 and 47' (FIG. 4) are moved so that sleeve apertures 41 and 41' (FIG. 4) align with the vertical aperture of the plurality of vertical apertures 49 and 49' (FIG. 1) which best corresponds to the level of raised leveler and support surface means 20. Leveler support rod 25 is then slid through sleeve bracket support 43 through a corresponding one of the plurality of leveler apertures 24, on the left and right sides of support plate frame 22, and through the sleeve bracket support (not shown) of sleeve 47' (FIG. 4) such that said two rod apertures align with said bracket apertures and said back sleeve apertures of sleeves 47 and 47'. Sleeve locking pins 44 are then slid into their respectively aligned apertures for securing sleeves 47 and 47' into position.

If safety support structure 10 is used outdoors, preferably, the plurality of anchoring means 50 and 50' are slid along the length of short frame bars 34 and 34' for securing safety support structure 10 to the underneath surface. When safety support structure 10 is used indoors, the plurality of anchoring means 50 and 50' should be removed so that the plurality of spikes 52 are not damaged. Lastly, the ladder is then placed upon leveler and support means 20, in a conventional manner.

Accordingly, if safety support structure 10 is used on observably flat soft soil or an otherwise level safe surface, vertical support structures 45 and 45' are rested horizontally upon long frame bars 32 and 32' and leveler and support surface means 20 rests upon short frame bar 34'. Henceforth, leveler and support surface means 20 securely supports the ladder or the like over the soft soil or the otherwise level safe surface for providing a safe and effective means of stability for the ladder.

It can be seen from the preceding description that a safety support structure for leveling a ladder placed thereupon and providing a support surface over an otherwise unsafe terrain, such as soft soil or sloping or uneven terrain, thereby eliminating danger to the user which is inexpensive and easy to assemble, easy to adjust for varying surfaces and usable outdoors, as well as, indoors has been provided.

It is noted that the embodiment of the safety support structure described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A safety support structure for supporting a ladder thereon over a surface, said safety support structure comprising:

a frame structure;

leveler and support surface means coupled to said frame structure for leveling said ladder and providing a support surface over said surface wherein one distal end of said leveler and support surface means is incrementally raised pivotally in accordance with a slope or unevenness of said surface;

a support plate formed substantially in the shape of a parallelogram and having a top surface area; and a pad disposed on said top surface area wherein said pad prevents said ladder placed thereon from sliding or skidding as a user climbs up the ladder;

said leveler and support surface means further comprising:

support plate frame surrounding the perimeter of said support plate perpendicularly coupled in the center thereof and formed substantially in the shape of an "L" for forming a ledge extending inward from and perpendicular to the lowermost edge of a vertical surface of said support plate frame wherein the vertical surface of said support plate frame forms a stop wall for preventing the ladder from moving off said support plate.

2. A safety support structure for supporting a ladder thereon over a surface, said safety support structure comprising:

leveler and support surface means for leveling said ladder and providing a support surface over said surface wherein one distal end of said leveler and support surface means is incrementally raised pivotally in accordance with a slope or unevenness of said surface;

a frame structure coupled to said leveler and support surface means, said frame structure comprising:

a plurality of vertical support means for providing vertical support for said leveler and support surface means, leveler support rod, and a plurality of sleeves each coupled to a respective one of said plurality of vertical support means and to said leveler support rod for positioning said leveler and support surface means in accordance with the level said leveler and support surface means is raised;

said leveler and support surface means comprising:

a support plate formed substantially in the shape of a parallelogram and having a top surface area;

a pad disposed on said top surface area wherein said pad prevents said ladder placed thereon from sliding or skidding, as a user climbs up the ladder; and a support plate frame surrounding the perimeter of said support plate perpendicularly coupled in the center thereof and formed substantially in the shape of an "L" for forming a ledge extending inward from and perpendicular to the lowermost edge of a vertical surface of said support plate frame wherein the vertical surface of said support plate frame forms a stop wall for preventing the ladder from moving off said support plate.

3. A safety support structure for supporting a ladder thereon over a surface, said safety support structure comprising:

leveler and support surface means for leveling said ladder and providing a support surface over said surface wherein one distal end of said leveler and support surface means is incrementally raised pivotally in accordance with a slope or unevenness of said surface, said leveler and support surface means comprising:

a support plate formed substantially in the shape of a parallelogram and having a top surface area, and a pad disposed on said top surface area wherein said pad prevents said ladder placed thereon from sliding or skidding, as a user climbs up the ladder; and a frame structure coupled to said leveler and support surface means, said frame structure comprising:

a plurality of vertical support means for providing vertical support for said leveler and support surface means, leveler support rod, and a plurality of sleeves each coupled to a respective one of said plurality of vertical support means and to said leveler support rod for positioning said leveler and support surface means in accordance with the level said leveler and support surface means is raised;

said leveler and support surface means further comprising:

a support plate frame surrounding the perimeter of said support plate perpendicularly coupled in the center thereof and formed substantially in the shape of an "L" for forming a ledge extending inward from and perpendicular to the lowermost edge of a vertical surface of said support plate frame wherein the vertical surface of said support plate frame forms a stop wall for preventing the ladder from moving off said support plate.

* * * * *